US008454307B2

(12) United States Patent
Cottrell et al.

(10) Patent No.: US 8,454,307 B2
(45) Date of Patent: Jun. 4, 2013

(54) SOCKET WITH BEARING BORE AND INTEGRATED WEAR PLATE

(75) Inventors: Matthew A. Cottrell, Woodbury, MN (US); Patrick A. Bear, Richfield, MN (US)

(73) Assignee: Sta-Rite Industries, LLC, Delavan, WI (US)

( * ) Notice: Subject to any disclaimer, the term of this patent is extended or adjusted under 35 U.S.C. 154(b) by 668 days.

(21) Appl. No.: 12/624,246

(22) Filed: Nov. 23, 2009

(65) Prior Publication Data

US 2010/0296921 A1 Nov. 25, 2010

Related U.S. Application Data

(60) Provisional application No. 61/118,348, filed on Nov. 26, 2008.

(51) Int. Cl.
*F04D 29/12* (2006.01)

(52) U.S. Cl.
USPC ..... 415/196; 415/197; 415/230

(58) Field of Classification Search
USPC ..... 415/196, 197, 206, 229, 230, 213.1
See application file for complete search history.

(56) References Cited

U.S. PATENT DOCUMENTS

| | | | | |
|---|---|---|---|---|
| 1,334,461 | A | | 3/1920 | Kerr |
| 2,517,477 | A | | 8/1950 | Griffin |
| 2,625,106 | A | | 1/1953 | Hoffman |
| 2,659,313 | A | | 11/1953 | Carson |
| 2,869,471 | A | | 1/1959 | Copeland |
| 3,213,800 | A | | 10/1965 | McAlvay et al. |
| 3,316,848 | A | * | 5/1967 | Egger ..... 415/204 |
| 3,354,529 | A | | 11/1967 | James |
| 3,485,178 | A | | 12/1969 | Dutton et al. |
| 3,552,888 | A | * | 1/1971 | Ericksson ..... 417/423.11 |
| 3,713,749 | A | | 1/1973 | Fitch |
| 3,776,659 | A | | 12/1973 | Coon, Jr. |
| 3,796,507 | A | | 3/1974 | Smykal et al. |
| 4,768,923 | A | | 9/1988 | Baker |
| 4,802,818 | A | | 2/1989 | Wiggins et al. |
| 4,913,619 | A | | 4/1990 | Haentjens et al. |
| 4,925,367 | A | | 5/1990 | Paliwoda et al. |
| 5,092,740 | A | | 3/1992 | Yamamura |
| 5,106,262 | A | * | 4/1992 | Oklejas et al. ..... 415/171.1 |
| 5,117,796 | A | * | 6/1992 | Tursky ..... 123/509 |
| 5,302,091 | A | * | 4/1994 | Horiuchi ..... 417/420 |
| 5,344,515 | A | | 9/1994 | Chenock, Jr. |
| 5,540,192 | A | | 7/1996 | Xanders |
| 5,971,704 | A | | 10/1999 | Blattmann |
| 6,079,959 | A | * | 6/2000 | Kingsford et al. ..... 417/393 |
| 6,234,748 | B1 | | 5/2001 | Brown et al. |
| 6,363,918 | B2 | | 4/2002 | Hakansson et al. |
| 6,599,086 | B2 | | 7/2003 | Soja |
| 6,887,048 | B2 | * | 5/2005 | Hirata et al. ..... 417/423.11 |

(Continued)

*Primary Examiner* — Edward Look
*Assistant Examiner* — Liam McDowell
(74) *Attorney, Agent, or Firm* — Quarles & Brady LLP

(57) ABSTRACT

Embodiments of the invention provide a pump with a housing including a pump chamber and an impeller positioned within the pump chamber. The pump also includes a socket with a wear plate, an inner ring, and an outer ring. The wear plate at least partially defines the pump chamber. The impeller is in contact with the wear plate. An outer surface of the outer ring is coupled to the housing. An inner surface of the outer ring receives a bearing. The inner ring receives a seal. A portion of the housing is molded over an end of the socket.

25 Claims, 5 Drawing Sheets

U.S. PATENT DOCUMENTS

| | | | | |
|---|---|---|---|---|
| 7,037,069 | B2 | 5/2006 | Arnold et al. | |
| 7,318,422 | B2 | 1/2008 | Douyama et al. | |
| 7,544,041 | B2 | 6/2009 | Mayleben et al. | |
| 2002/0034438 | A1* | 3/2002 | Ozawa et al. | 415/111 |
| 2003/0012640 | A1* | 1/2003 | Rosso et al. | 415/110 |
| 2004/0081381 | A1 | 4/2004 | Bureaugard et al. | |
| 2005/0013689 | A1* | 1/2005 | Racer et al. | 415/206 |
| 2006/0275162 | A1 | 12/2006 | Mayleben et al. | |
| 2008/0232988 | A1 | 9/2008 | Schaupp | |

* cited by examiner

SOCKET WITH BEARING BORE AND INTEGRATED WEAR PLATE

RELATED APPLICATIONS

This application claims priority under 35 U.S.C. §119 to U.S. Provisional Patent Application No. 61/118,348 filed on Nov. 26, 2008, the entire contents of which is incorporated herein by reference.

BACKGROUND

An impeller pump includes an impeller running in a pumping chamber within a housing of the pump. The impeller is mounted on a shaft to which a drive pulley is coupled. An impeller pump performs best when a gap between an interior wall of the pumping chamber and the impeller is as small as possible. To achieve high efficiencies, this gap should be constant over the depth of the impeller.

Metal pump housings are commonly used for impeller pumps. One advantage of a metal housing is its structural integrity. Strong lateral forces can be applied to the drive pulley before the shaft is displaced or bent, which results in performance losses or destruction of the pump. For marine applications, the metal pump housing typically decomposes over time when aggressive fluids (e.g., salt water or water with a high chlorine content) are pumped.

Composite pump housings have been used due to their ability to withstand a wider range of aggressive fluids, especially chlorine water, while being more cost effective than precious metals. Additionally, whenever the weight of the pump is important, the composite pump housings have clear advantages over their metal counterparts. Disadvantages of the composite pump housings include their inability to compensate shear forces. Strong lateral forces applied to the drive pulley can decrease the performance of the pump more rapidly or even destroy the pump more easily as compared to the metal pump housings. Attempts to overcome this limitation of the composite pump housings include increasing wall thicknesses throughout the pump housing and/or reinforcing the composite pump housing. The wall thicknesses required for the strong forces applied to the shaft in modem applications would result in undesirable pump dimensions. However, reinforcing the pump housing by, for example, wood or metal inserts, can result in cracking at the interfaces of the reinforcement. Additionally, either solution is less cost effective.

SUMMARY

Some embodiments of the invention provide a pump with a housing including a pump chamber and an impeller positioned within the pump chamber. The pump also includes a socket with a wear plate, an inner ring, and an outer ring. The wear plate at least partially defines the pump chamber. The impeller is in contact with the wear plate. An outer surface of the outer ring is coupled to the housing. An inner surface of the outer ring receives a bearing. The inner ring receives a seal. A portion of the housing is molded over an end of the socket.

DETAILED DESCRIPTION

Figure 1:
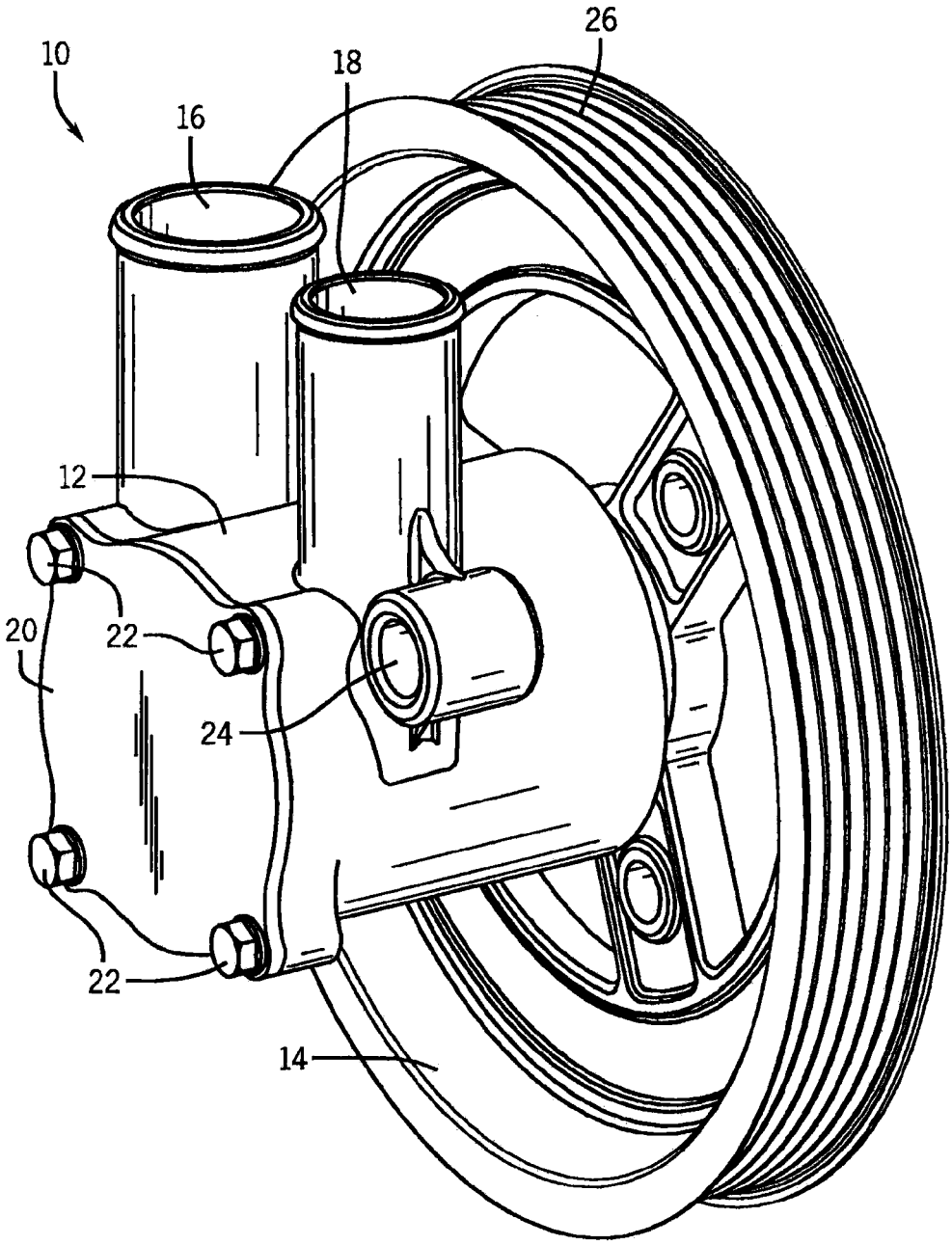
FIG. 1 is a perspective view of a pump according to some embodiments of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

FIG. 1 illustrates a pump 10 including a housing 12 and a pulley 14. The housing 12 can include an inlet 16, an outlet 18, and a lid 20 coupled to the housing 12 with fasteners 22. In some embodiments, the housing 12 can be made from composite materials. The pump 10 can be coupled to a structure (not shown) by a mount 24. The pulley 14 can include a tread 26 for a belt (not shown).

Figure 2:
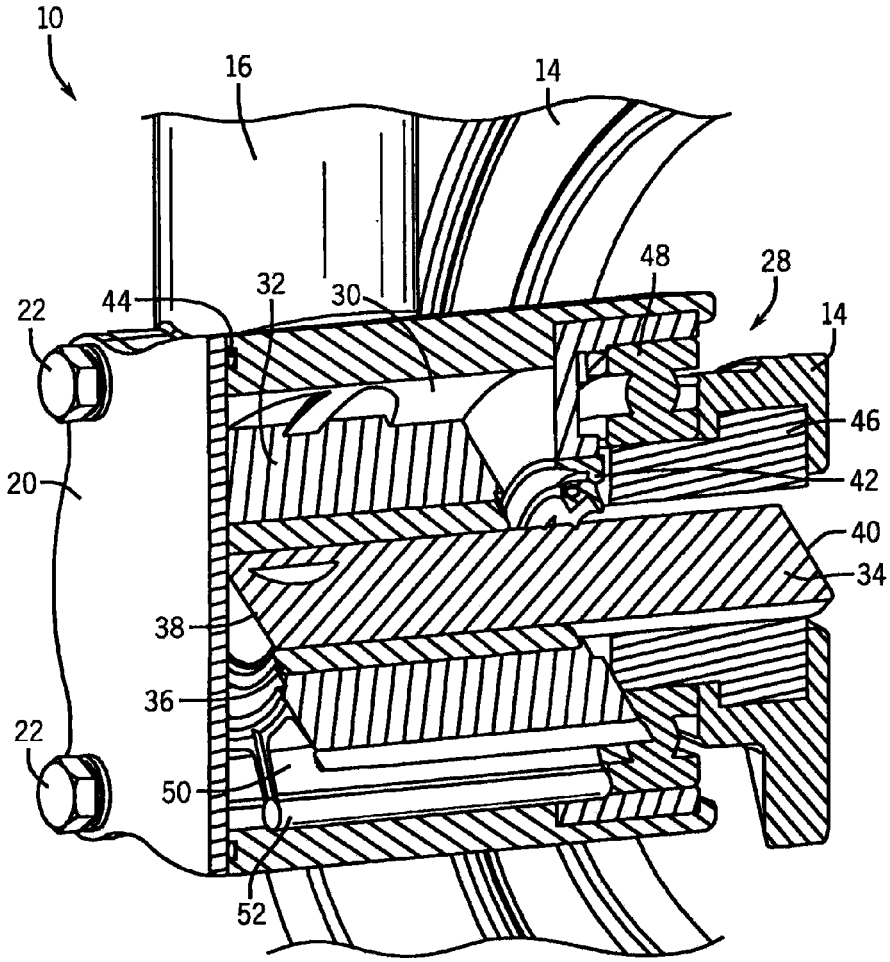
FIG. 2 is a perspective cross-sectional view of the pump of FIG. 1.

FIG. 2 illustrates the pump 10 and its main components according to some embodiments of the invention. The pump 10 can include a socket 28 and a pump chamber 30. In some embodiments, the socket 28 can be a single component. The socket 28 can be coupled to the housing 12. In some embodiments, the socket 28 can be at least partially enclosed by the housing 12. The pump chamber 30 can be defined by the lid 20, the socket 28, and the housing 12. The pump chamber 30 can enclose an impeller 32. The impeller 32 can be coupled to a shaft 34 by a bushing 36. The shaft 34 can include a first end 38 and a second end 40. The first end 38 can be adjacent to the lid 20. A portion of the impeller 32 can be positioned adjacent to the first end 38 and/or the lid 20. The second end 40 of the shaft 34 can extend beyond the pump chamber 30 and can protrude from the socket 28. The pump chamber 30 can be made water tight by a seal 42 and an O-ring 44. The seal 42 can be positioned within the socket 28 and can engage the shaft 34. The O-ring 44 can seal a connection between the housing 12 and the lid 20. The pulley 14 can be coupled to the second end 40 of the shaft 34 by a guide 46. The guide 46 can be adjacent to the seal 42. The guide 46 can be coupled to the socket 28 by a bearing 48. The bearing 48 can couple the shaft 34 to the socket 28. The bearing 48 can enable a rotational movement of the impeller 32 and the shaft 34 with respect to the housing 12. In some embodiments, the bearing 48 can be a ball bearing.

In some embodiments, the impeller 32 can include several extensions 50. In some embodiments, the extensions 50 can be made from a resilient material. A distal end of each extension 50 can include a protuberance 52. In some embodiments, the protuberance 52 can be in contact with a wall of the pump chamber 30 so that the extensions 50 can bend during the operation of the pump 10.

Figure 3A:
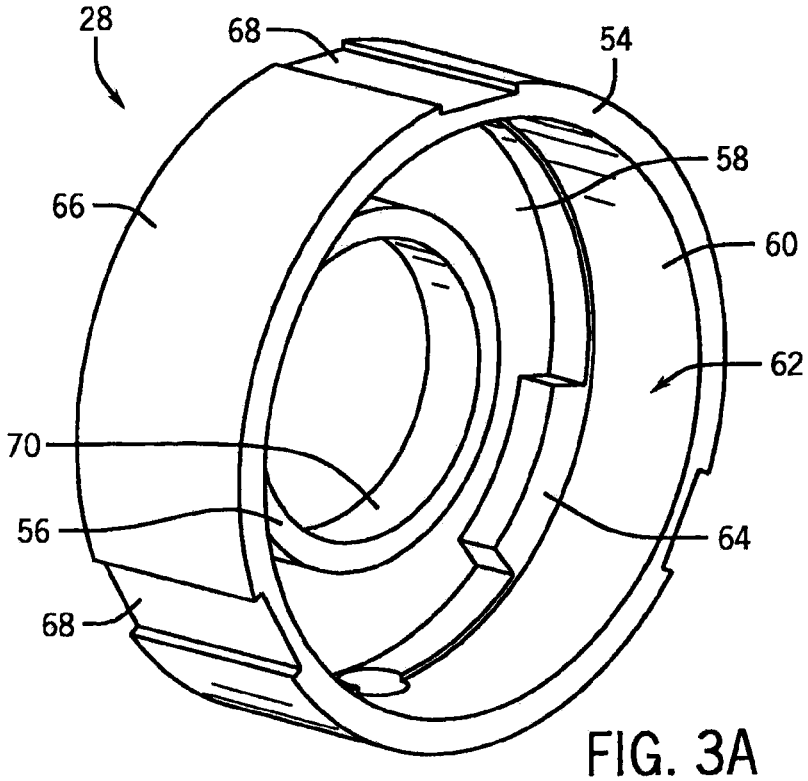
FIG. 3A is a perspective view of a socket according to one embodiment of the invention.

FIG. 3A illustrates the socket 28 according to one embodiment of the invention. The socket 28 can include an outer ring 54, an inner ring 56, and a wear plate 58. The wear plate 58 can connect the outer ring 54 and the inner ring 56. An inner surface 60 of the outer ring 54 can define a bearing bore 62. The inner surface 60 can also include projections 64. The projections 64 can define a depth of the bearing bore 62. An outer surface 66 of the outer ring 54 can include one or more grooves 68. The outer surface 66 can be used to couple the socket 28 to the housing 12. In some embodiments, the grooves 68 can prevent rotational movement of the socket 28 with respect to the housing 12. The inner ring 56 can include a seal surface 70. The seal surface 70 can be used to couple the seal 42 to the socket 28 so that the inner ring 54 can at least partially enclose the seal 42.

Figure 3B:
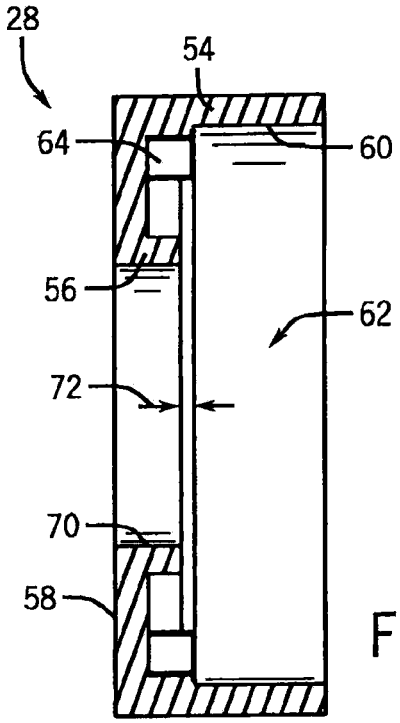
FIG. 3B is a cross-sectional view of the socket of FIG. 3A.

In some embodiments, the outer ring 54 and the inner ring 56 can extend from the wear plate 58 in the same direction, as shown in FIG. 3B. The wear plate 58 can couple the outer ring 54 and the inner ring 56 together at one end of the outer ring 54 and the inner ring 56. As a result, the wear plate 58 can include a substantially smooth surface. As shown in FIG. 3B, the projections 64 can introduce an offset 72 between the bearing bore 62 and the seal surface 70. In some embodiments, the offset 72 can prevent the guide 46 and/or the bearing 48 from contacting the seal 42.

Figure 4A:
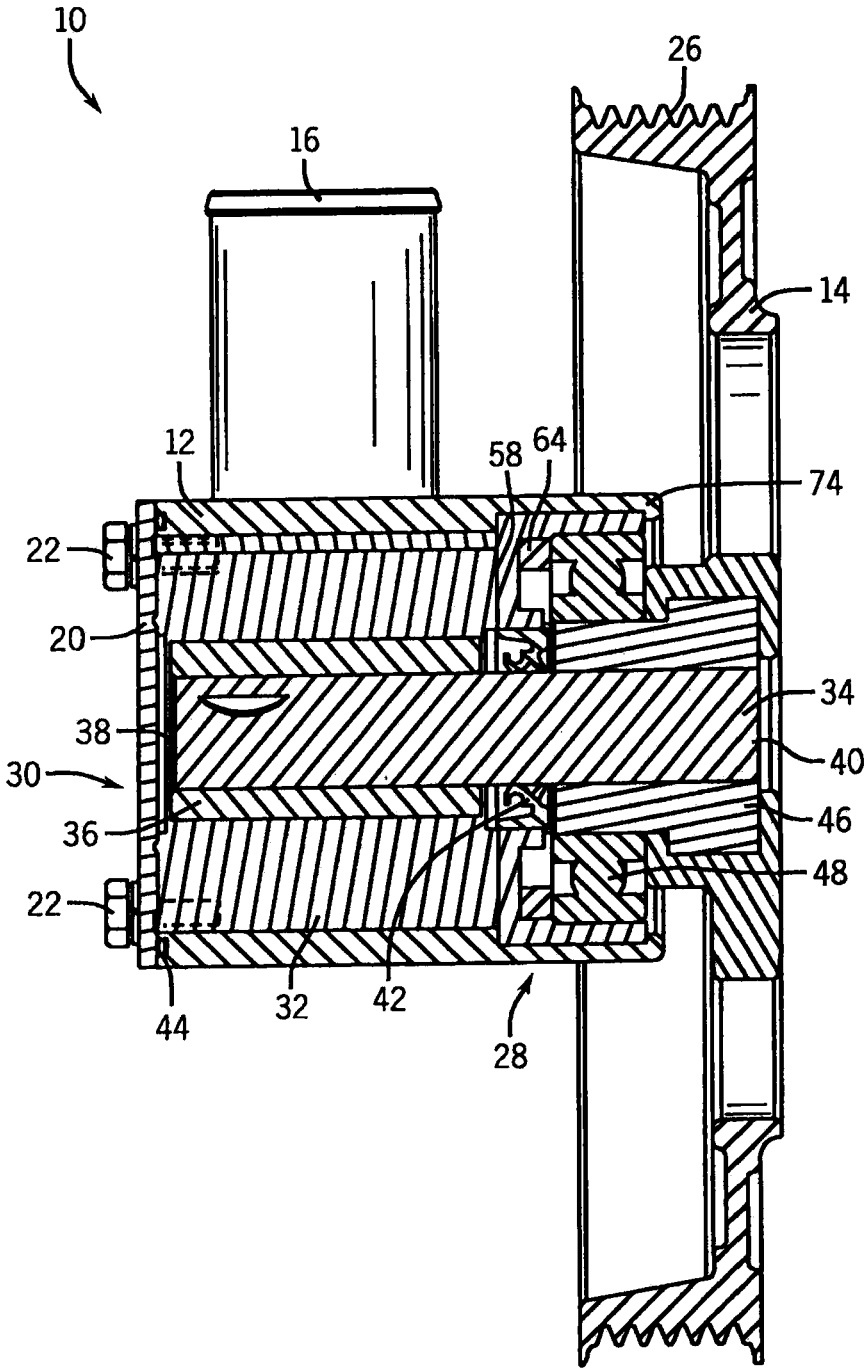
FIG. 4A is a cross-sectional view of the pump of FIG. 1 including the socket of FIGS. 3A and 3B.

FIG. 4A illustrates a cross section of the pump 10. The socket 28 can be molded into the housing 12 opposite to the lid 20. The socket 28 can be at least partially overmolded by an annex 74 of the housing 12. As a result, a gasket is not necessary to make the connection between the housing 12 and the socket 28 waterproof. The pump chamber 30 can be defined by the housing 12, the lid 20, and the wear plate 58. The pump chamber 30 can enclose the impeller 32, the bushing 36, and a portion of the shaft 34. In some embodiments, lateral edges of the impeller 32 can be in contact with the lid 20 and/or the wear plate 58.

In some embodiments, the socket 28 and/or the lid 20 can be manufactured from metal so that heat generated by friction between the impeller 32 and the pump chamber 30 can be dissipated away from the pump chamber 30. The heat generated by the friction can impact performance of the pump 10, can cause damage to the impeller 32 and/or the seal 42, and can create heat blisters within the pump chamber 30. In some embodiments, the socket 28 can result in improved dry run conditions of the pump 10 (i.e., no fluid is being pumped while the pump 10 is running). As a result, overheating of the housing 12, damage to the impeller 32, excessive wear of the seal 42, and/or the generation of the heat blisters within the pump chamber 30 can be prevented or reduced.

Some applications of the pump 10 can require the pulley 14 to be rather large to achieve low gear ratios in combination with a rather small pulley of a motor (not shown) driving the pump 10. As size of the pulley 14 increases, lateral forces applied to the shaft 34 can increase proportionally. The socket 28 can compensate the lateral forces so that the pump 10 only needs a single bearing 48. In some embodiments, the socket 28 can enable reliable operation of the pump 10 without having to provide support for the first end 38 of the shaft 34 (e.g., by a bearing in the lid 20). In some embodiments, the first end 38 of the shaft 34 can form a substantially free end.

Figure 4B:
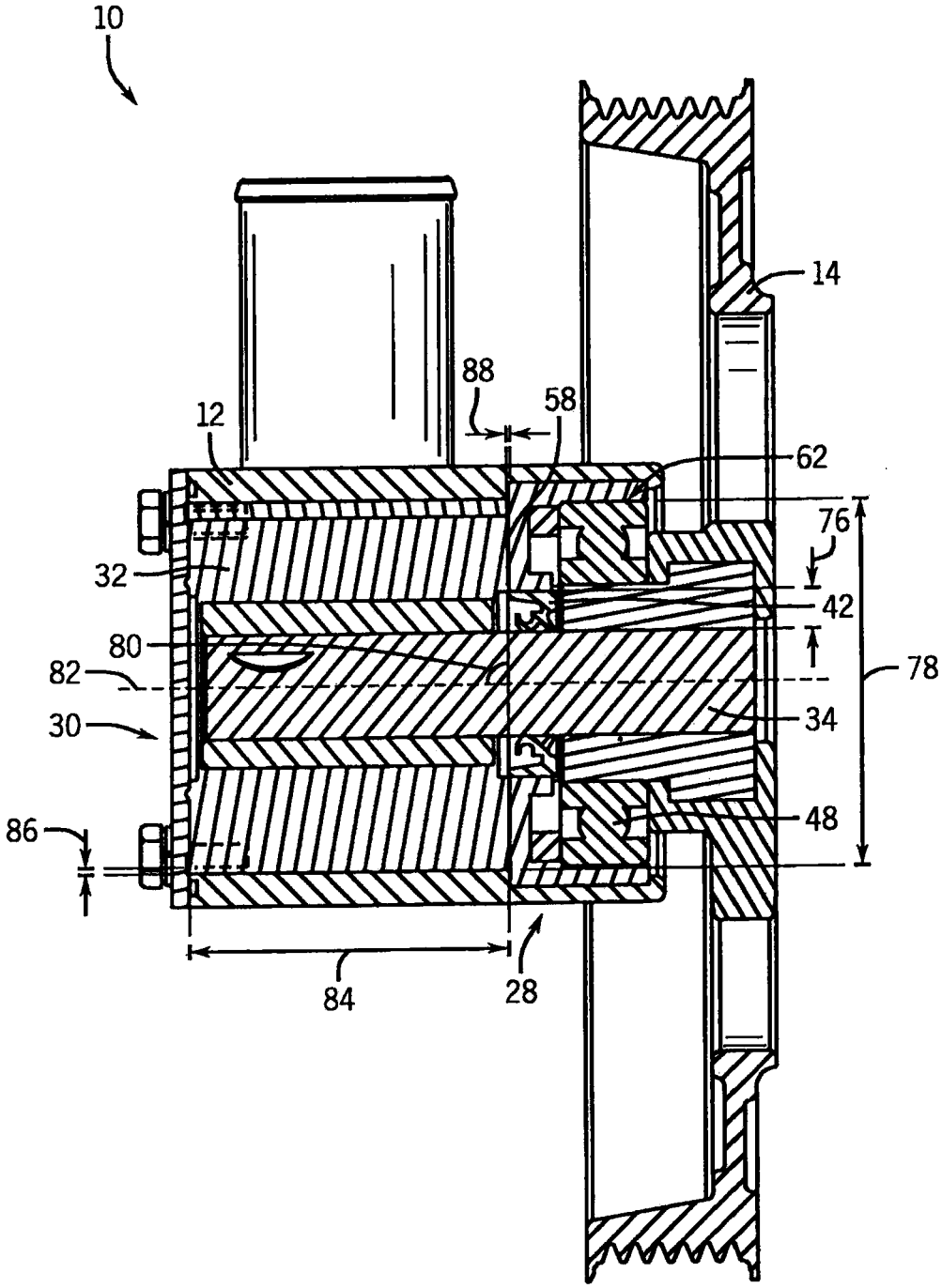
FIG. 4B is a cross-sectional view of the pump of FIG. 1 illustrating an alignment of the socket of FIGS. 3A and 3B according to one embodiment of the invention.

FIG. 4B illustrates the alignment of the socket 28 in the pump 10. The socket 28 can align the shaft 34 and the seal 42 (as indicated by an alignment distance 76). The alignment distance 76 of the shaft 34 and the seal 42 can reduce the possibility of a leak during operation of the pump 10. The socket 28 can help keep the shaft 34 and the sealing surface 70 substantially parallel. As a result, the socket 28 can help reduce wear of the seal 42. The socket 28 can align the impeller 32 with the bearing 48 (as indicated by an alignment distance 78) so that an axis of rotation 82 of the shaft 34 and a lateral side of the impeller 32 and/or the wear plate 58 can be maintained perpendicular (as indicated by an angle 80). As a result, the impeller 32 can be concentrically aligned with the pump chamber 30 over a depth 84 of the impeller 82. The socket 28 can minimize a gap 86 between the wall of the pump chamber 30 and an outermost perimeter of the impeller 32. The alignment distance 78 of the impeller 34 and the bearing 48 can maintain a substantially constant gap 86 over the entire depth 84 of the impeller 82. Minimizing the gap 86 can increase the performance of the pump 10.

The socket 28 can also minimize a gap 88 between the wear plate 58 and the impeller 34. The alignment distance 78 of the impeller 34 and the bearing 48 can maintain a substantially constant gap 88 along the wear plate 58 and/or over a height of the pump chamber 30. The pulley 14 can be substantially larger than an exterior dimension of the housing 12 and introduce strong lateral forces and moments on the shaft 34. However, the alignment distance 76, the alignment distance 78, the angle 52, the constant gap 86, and the constant gap 88 can be maintained with minimal deviations in order to provide superior pump performance, especially for a composite housing.

Although the socket 28 has been described with respect to an impeller pump 10, the socket 28 is not limited to impeller pumps and can be included in other suitable pumps. The socket 28 can be particularly beneficial in pumps having a composite housing.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

The invention claimed is:

1. A pump comprising:

a housing including a pump chamber;

an impeller positioned within the pump chamber, the impeller configured to be mounted to a shaft; and a socket including a wear plate, an inner ring, and an outer ring, the wear plate at least partially defining the pump chamber, the impeller in contact with the wear plate, an outer surface of the outer ring coupled to the housing, an inner surface of the outer ring receiving a bearing, the inner ring receiving a seal, the seal configured to engage the shaft, a portion of the housing molded over an end of the socket.

2. The pump of claim 1, wherein the housing is constructed of composite materials.

3. The pump of claim 1, wherein the shaft couples the impeller to the bearing.

4. The pump of claim 3, wherein the socket maintains a substantially perpendicular angle between an axis of rotation of the shaft and the wear plate.

5. The pump of claim 3, wherein the socket maintains the shaft substantially parallel to the inner ring.

6. The pump of claim 3, wherein the socket maintains the shaft substantially parallel to the outer ring.

7. The pump of claim 3, and further comprising a pulley coupled to a first end of the shaft.

8. The pump of claim 7, wherein a second end of the shaft includes a free end without a bearing.

9. The pump of claim 1, wherein the socket maintains a substantially constant gap between the impeller and an inner wall of the pump chamber.

10. The pump of claim 1, wherein the socket maintains a substantially constant gap between a lateral side of the impeller and the wear plate.

11. The pump of claim 1, wherein the outer ring and the inner ring extend from the wear plate.

12. The pump of claim 11, wherein the outer ring and the inner ring extend in the same direction.

13. The pump of claim 1, wherein the outer ring includes projections that engage the bearing.

14. The pump of claim 13, wherein the projections introduce an offset between the seal and the bearing.

15. The pump of claim 1, wherein the socket dissipates heat from the pump chamber.

16. The pump of claim 1, wherein the socket improves a dry-run condition of the pump.

17. A socket for use in a pump housing, the socket comprising:

an outer ring;

an inner ring; and a wear plate, the outer ring and the inner ring extending from the wear plate on a first side, an outer surface of the outer ring coupled to the pump housing, an inner surface of the outer ring forming a bearing bore that receives a bearing, the inner ring including an innermost radial side providing a seal surface, the seal surface receiving a seal.

18. The socket of claim 17, wherein the inner ring and the outer ring are integrally formed with the wear plate.

19. The socket of claim 17, wherein the outer ring includes projections limiting a depth of the bearing bore.

20. The socket of claim 17, wherein the bearing bore maintains an offset between the bearing and the seal.

21. The socket of claim 17, wherein the wear plate include a smooth surface on a second side substantially opposite to the first side.

22. The socket of claim 17, wherein the wear plate keeps the bearing bore and the inner ring centrally aligned.

23. The socket of claim 17, wherein the wear plate maintains an angle between the outer ring and the wear plate.

24. The socket of claim 17, wherein the wear plate dissipates heat to the inner ring and the outer ring.

25. The socket of claim 17, wherein the outer ring includes grooves to prevent movement of the socket with respect to the pump housing.

* * * * *